US008002683B1

(12) United States Patent
Nayebdadash

(10) Patent No.: US 8,002,683 B1
(45) Date of Patent: Aug. 23, 2011

(54) ABDOMINAL EXERCISE DEVICE WITH PLUNGER

(75) Inventor: Ali Nayebdadash, Marina Del Rey, CA (US)

(73) Assignee: Lear Fitness, Inc., Marina Del Rey, CA (US)

( * ) Notice: Subject to any disclaimer, the term of this patent is extended or adjusted under 35 U.S.C. 154(b) by 0 days.

(21) Appl. No.: 12/703,107

(22) Filed: Feb. 9, 2010

(51) Int. Cl.
*A63B 71/00* (2006.01)

(52) U.S. Cl. ..... 482/140

(58) Field of Classification Search ..... 482/140, 482/91, 907–908, 148, 139, 62, 51, 126
See application file for complete search history.

(56) References Cited

U.S. PATENT DOCUMENTS

| | | | | | |
|---|---|---|---|---|---|
| 1,244,371 | A | | 10/1917 | Reynolds | |
| 2,429,939 | A | | 10/1947 | Masterson et al. | |
| 4,198,044 | A | | 4/1980 | Holappa | |
| 4,632,393 | A | * | 12/1986 | Van Noord | 482/133 |
| 4,729,562 | A | | 3/1988 | Pipasik | |
| 4,752,067 | A | | 6/1988 | Colonello | |
| 4,863,158 | A | | 9/1989 | Tassone | |
| 4,902,003 | A | | 2/1990 | Buoni | |
| 5,147,259 | A | | 9/1992 | Hutchins | |
| 5,299,998 | A | | 4/1994 | Hutchins | |
| 5,407,404 | A | | 4/1995 | Killian et al. | |
| 5,492,520 | A | | 2/1996 | Brown | |
| 5,545,114 | A | | 8/1996 | Gvoich | |
| 5,577,987 | A | | 11/1996 | Brown | |
| 5,616,109 | A | | 4/1997 | Szu-Ming | |
| 5,728,035 | A | * | 3/1998 | Sands | 482/140 |
| 5,820,535 | A | | 10/1998 | Van Der Hoeven et al. | |
| 5,882,284 | A | * | 3/1999 | Cayne | 482/130 |
| 5,931,768 | A | | 8/1999 | Amesquita | |
| 5,935,049 | A | | 8/1999 | Hamm | |
| 5,941,806 | A | | 8/1999 | Olschansky et al. | |
| D413,948 | S | | 9/1999 | Dalebout | |
| 5,997,450 | A | | 12/1999 | Wilkinson | |
| 6,048,293 | A | | 4/2000 | Lee | |
| 6,117,057 | A | | 9/2000 | Olschansky | |
| 6,203,473 | B1 | | 3/2001 | Atwood | |
| 6,213,923 | B1 | | 4/2001 | Cameron et al. | |
| 6,592,500 | B1 | | 7/2003 | McBride et al. | |
| 6,939,277 | B2 | | 9/2005 | Tuller et al. | |
| 7,041,040 | B2 | * | 5/2006 | Dovner et al. | 482/124 |
| 7,074,165 | B1 | | 7/2006 | Hodge et al. | |
| 7,172,539 | B1 | | 2/2007 | Bythewood et al. | |
| 7,232,405 | B2 | | 6/2007 | Ko | |
| 2003/0181297 | A1 | | 9/2003 | Suiter | |
| 2004/0014570 | A1 | | 1/2004 | Centopani | |
| 2005/0137068 | A1 | | 6/2005 | Boland et al. | |
| 2006/0052225 | A1 | | 3/2006 | Stearns | |
| 2006/0166799 | A1 | | 7/2006 | Boland et al. | |

* cited by examiner

*Primary Examiner* — Lori Baker
(74) *Attorney, Agent, or Firm* — Kindred | Posey; Ivan Posey, Esq.

(57) ABSTRACT

An apparatus for abdominal exercise comprises a pair of laterally spaced u-shaped support rails for rocking back and forth on a surface. A pair of arm rests are each connected to the inside u-shape portion of one of the support rails and extend rearwardly from the contact point to the surface to receive an elbow of a person disposed between said rails in a supine position. A first connecting portion connects the support rails above the contact point to the surface. A second connecting portion connects the support rails behind the contact point to the surface. A plunger is connected to said first connecting portion whereby a person disposed supinely on said support surface and between said support rails and with one of the hands or arms of the person engaging said first connecting portion is able to conduct a curling exercise to exercise the abdominal muscles of the person while rocking said device, and wherein said plunger is positioned to engage a user's abdomen to provide a kinetic and isometric force.

17 Claims, 13 Drawing Sheets

ABDOMINAL EXERCISE DEVICE WITH PLUNGER

An abdominal exercise device with a plunger is described. Specifically, an apparatus for abdominal exercise comprises two u-shaped side bar portions with a top w-shaped, or zig-zag-shaped, crossbar member having an adjustable plunger clamped thereto, and a lower crossbar member with a novel headrest attached thereto.

BACKGROUND OF THE INVENTION

Various prior art systems have been devised as attempts to provide users with abdominal exercise methods. For example, one of the more popular prior art systems is known as the ABROLLER, which provides a typical roller-type device having a frame defining a pair of u-shaped support rails, a headrest, a pair of armrest portions and an upstanding arch-shaped portion connecting the support rails together. The user lies inside the device between the support rails and rotates forward with the roller device to exercise the abdominal muscles. Such a device is also illustrated in U.S. Pat. No. 5,492,520 issued to Brown.

A variation of the Brown device is described in U.S. Pat. No. 5,882,284 issued Cayne. The Cayne device adds a hinged, flat lower portion that stays stationary with respect to the roller device. The stationary lower portion stays flat on the ground while the user rolls the hinged roller portion. Connected to the stationary flat portion is a post that holds stationary plunger over the user's abdomen. However, the vary nature of the plunger's dependence on the flat stationary portion that stays on the ground prevents consistent kinetic and isometric pressure on the abdomen throughout the whole rolling exercise.

None of the above patents describes a suitable system that provides consistent kinetic and isometric pressure on selected parts of the user's abdomen throughout the rolling crunch exercises. Further, none of the above prior art, taken either singularly or in combination, is seen to describe the instant invention as claimed. Thus an abdominal exercise device that solves the aforementioned problems is desired.

SUMMARY OF THE INVENTION

In order to solve the problems and shortcomings of the prior art, an apparatus is disclosed for more efficient abdominal exercise. According to one preferred embodiment, the apparatus for abdominal exercise comprises a pair of laterally spaced u-shaped support rails for rocking back and forth on a surface. A pair of arm rests are each connected to the inside u-shape portion of one of the support rails and extend from a rearward point relative to the contact point of surface to receive an elbow of a person disposed between said rails in a supine position. A first connecting portion connects the support rails above the contact point to the surface. A second connecting portion connects the support rails behind the contact point to the surface.

A plunger is connected to said first connecting portion whereby a person disposed supinely on said support surface and between said support rails and with one of the hands or arms of the person engaging said first connecting portion is able to conduct a curling exercise to exercise the abdominal muscles of the person while rocking said device, and wherein said plunger is positioned to engage a user's abdomen to provide a kinetic and isometric force.

In one preferred embodiment, the plunger comprises a gas-filled piston. In another preferred embodiment, the plunger comprises a spring loaded piston. In yet another preferred embodiment, the plunger comprises an adjustable resistance plunger. In yet another preferred embodiment, the plunger further comprises one or more detachable resistance bands to adjust the resistance provided by the plunger.

In one preferred embodiment, the plunger has a top and a bottom. The bottom comprises the portion that engages the user's abdomen. The distance between the first connecting portion and the bottom of the plunger is adjustable.

In another preferred embodiment, the plunger is mounted on the first connecting portion by means of pivoting clamp allowing the plunger to pivot with respect to the connecting portion. Even after locking the plunger at the desired angle to contact the user's body, a small range of pivot is still allowed. A pivot stop pad restricts the range of pivot of the plunger to between, by way of example only, and not by way of limitation, 0 and 15 degrees. In yet another preferred embodiment, the pivot stop pad restricts the range of pivot of the plunger to between, by way of example only, and not by way of limitation, 0 and 10 degrees. In yet another preferred embodiment, the pivot stop pad restricts the range of pivot of the plunger to between, by way of example only, and not by way of limitation, 0 and 5 degrees. In one preferred embodiment, a spring is used to bias the pivot angle of the plunger to 0 degrees.

In one preferred embodiment, a headrest is attached to the second connecting portion. The headrest includes a bulbous portion that supports the neck area of the user and prevents sliding of the user's body relative to the apparatus. In one preferred embodiment, the headrest is also able to rotate slightly in order to provide comfort to the user of the apparatus during exercise.

DETAILED DESCRIPTION OF THE PREFERRED EMBODIMENTS

Figure 1:
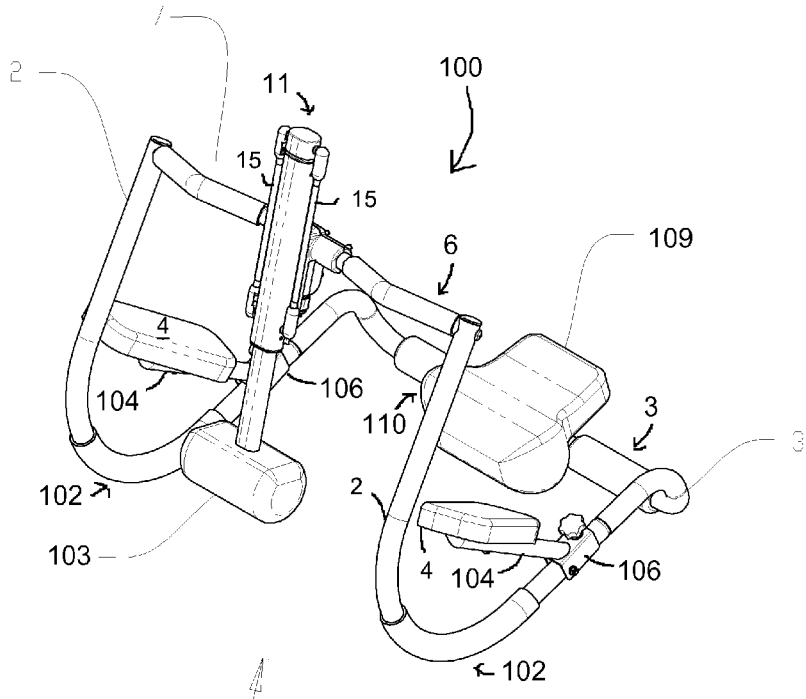
FIG. 1 is left-front perspective view of an apparatus for abdominal exercise according to one embodiment.

For the purpose of illustrating the invention, there is shown in the accompanying drawings several embodiments of the invention. However, it should be understood by those of ordinary skill in the art that the invention is not limited to the precise arrangements and instrumentalities shown therein and described below.

The apparatus for abdominal exercise in accordance with preferred embodiments of the present invention is illustrated in FIGS. 1-14 wherein like reference numerals are used throughout to designate like elements.

With reference to FIG. 1, a left-top perspective view of the apparatus 100 is shown in accord with one embodiment. The apparatus 100 comprises a pair of laterally spaced u-shaped support rails 2 for rocking back and forth on a surface. A pair of arm rests 4 are each connected to the inside u-shape portion of one of the support rails 2 via an arm pad support bar 104. Each arm rest 4 and arm pad support bar 104 comprises arm rest support connector portion 106 located rearwardly from the contact point 102 to the surface to receive an elbow of a person disposed between said rails 2 in a supine position. A first connecting portion, or hand grip bar 6, connects the support rails 2 above the surface contact point 102. A second connecting portion, or head cross bar 3, connects the support rails 2 behind the surface contact point 102. A headrest 109 is attached to the second connecting portion 5. In this embodiment, the headrest 109 is also able to rotate slightly in order to provide comfort to the user of the apparatus during exercise.

A plunger 11 is connected to said first connecting portion 6 whereby a person disposed supinely on said support surface and between said support rails 2 and with one of the hands or arms of the person engaging said first connecting portion 6 is able to conduct a body curling exercise to exercise the abdominal muscles of the person while rocking said apparatus 100, and wherein said plunger 11 is positioned to engage a user's abdomen to provide a kinetic and isometric force.

In one embodiment, the plunger 11 comprises a gas-filled piston. In another preferred embodiment, the plunger 11 comprises a spring loaded piston. In yet another embodiment, the plunger 11 comprises an adjustable resistance plunger. In yet another embodiment, the plunger 11 further comprises one or more detachable resistance bands 15 to adjust the resistance provided by the plunger 11. In one embodiment, each of the resistance bands 15 are each independently detachable in order to provide varying resistance to the plunger 15. An abdominal cushion, or pressure pad, 103 comprises the contact point to the users abdomen or other selected part of the user's body.

Figure 2:
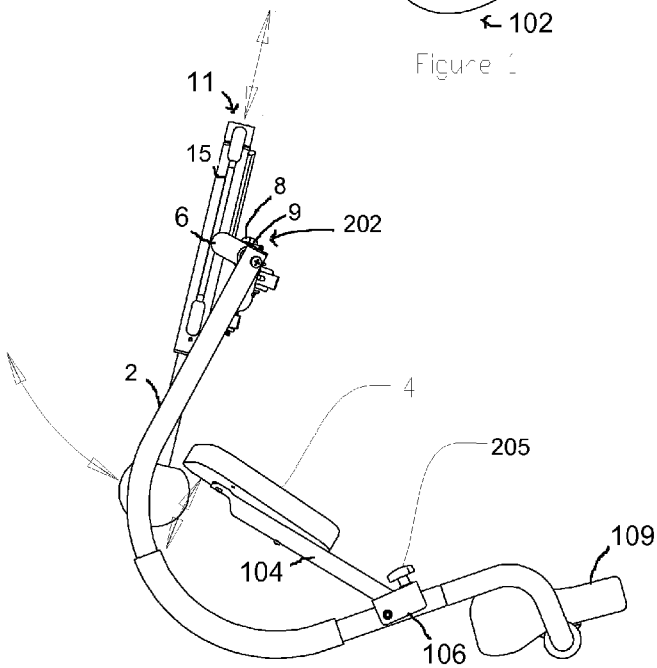
FIG. 2 is a left-side view of the apparatus of FIG. 1.

With reference to FIG. 2, a left-side view of the apparatus 100 is sown. In one embodiment, the plunger 11 is mounted on the first connecting portion 6 by means of a clamp 202. The clamp 202 is comprised of a guide track receiver 8 mated to a guide track receiver clamp 9 that receives the connecting portion 6 there between. As will be explained in more detail below, the clamp 200 is configured to allow the plunger 11 to pivot with respect to the connecting portion within a range of motion during exercise, but is also adjustable to change the whole angle of the plunger and contact point with respect to the user's body, and to allow the plunger 11 to be completed rotated out of the way to allow for the user's easy ingress and egress into and out of the apparatus 100.

In one embodiment, each armrest support connector portion 106 contains holes that align with holes in the u-shaped support rails 2 through which a bolt fits. On top of the arm rest support connector portion 106 is a hole through which a threaded knob 205 fits for insertion through the armrest connector portion 106 into the relative u-shaped support rail 2. This configuration allows for a variable pivot of the arm rest support connector portion 106 to therefore allow for variable pivot of the arm rest 4 according to preference of the user of the apparatus 100.

Figure 3:
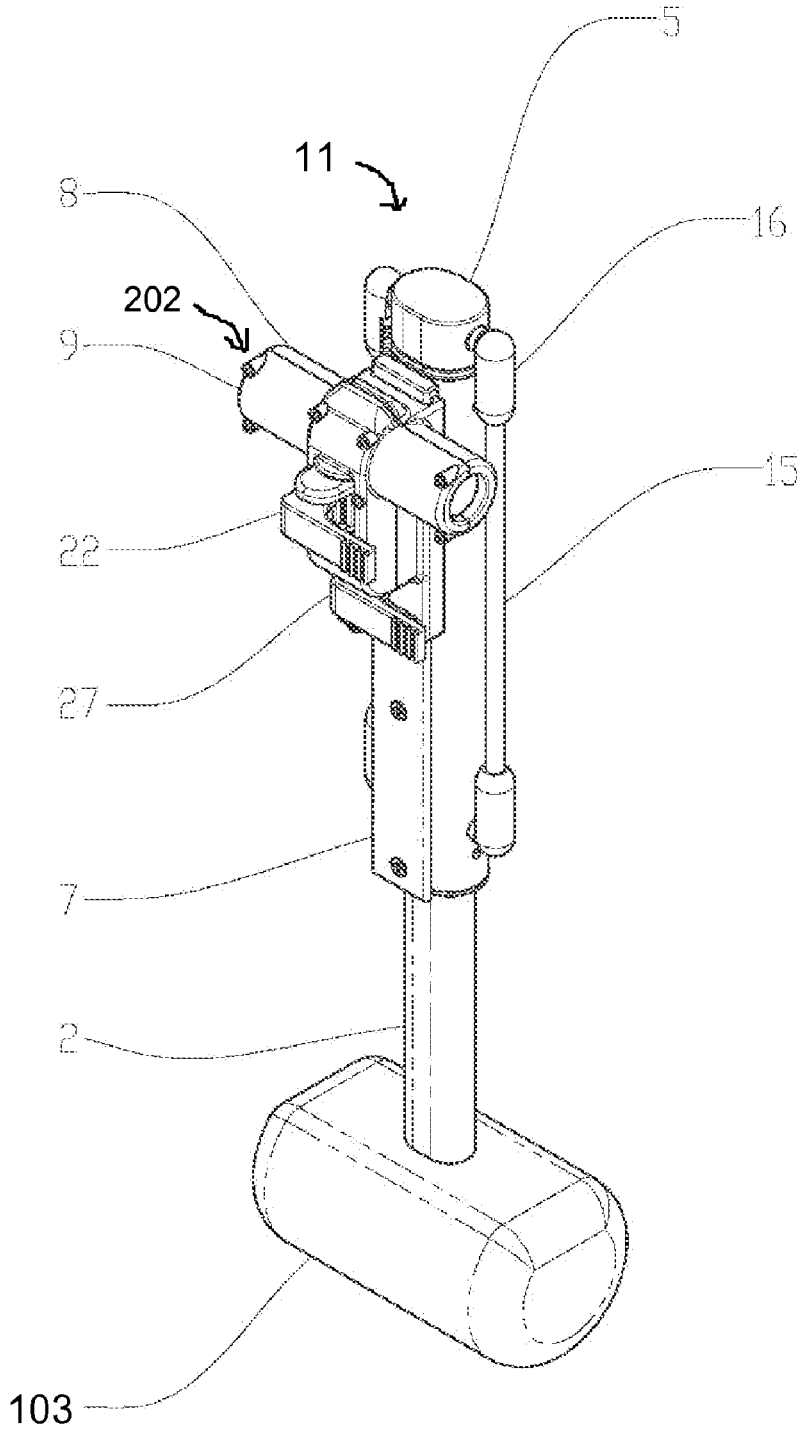
FIG. 3 is a rear perspective view of one embodiment of a plunger that can be used in the embodiment of FIG. 1.

With reference to FIG. 3, a right-rear perspective view of the plunger 11 is shown according to one embodiment. The plunger 11 comprises an outer plunger tube 301 and an inner plunger tube 302 that has the pressure pad 103 on a lower end and inserts through the outer plunger tube 301 with the upper end sticking out above the outer plunger tube 302. In one embodiment, the outer plunger tube 301 is made of plain carbon steel, and the inner plunger tube 302 is made of chrome plated carbon steel. However, those skilled in the art would recognize that a variety of materials can be used for various parts of the plunger 11, and parts of the apparatus 100 in general, such as extruded plastics, polymers, alloys, aluminium compounds, and the like.

The upper end of the inner plunger tube 302 that extends through the top of the outer plunger tube 301 has a plunger cap 5 to which the top of the one or more detachable resistance bands 15 are attached. The bottom of the one or more detachable resistance bands 15 are attachable to the bottom end of the outer tube, such that the one or more detachable resistance bands stretch as the plunger 11 compresses. Each detachable resistance band 15 can be added to increase resistance to the abdomen, or whatever part of the body the pressure pad 103 engages. Conversely, as each resistance band 15 is detached, resistance is decreased.

The clamp assembly 202 is shown as formed by the guide track receiver 8 mated to a guide track receiver clamp 9. A clamp pivot lever 22 provides for tightening and release of the clamp on the first connecting portion 6. This allows the user to pivot the plunger 11 to virtually any angle such that the pressure pad 103 can contact any part of the user's abdomen or other part of the body as desired during exercise, and so that the plunger can be rotated completely out of the way to allow for the user's easy ingress and egress into and out of the apparatus 100. A slide lock lever 27 provides for adjustability of the plunger 11 up and down with respect to the first connecting portion 6 along a plunger guide track 7. As the user positions the plunger 11 so that the pressure pad 103 contacts different parts of the body, the user can also slide the plunger 11 up and down with respect to the connecting portion 6 so that the pressure pad 103 contacts the user's body properly. For example, in some embodiments, it may be desirable for the plunger 11 to be in a position such that it is not in a compressed state at the beginning of the exercise, as the user can angle the plunger 11 to contact portions of the upper or lower abdomen.

Figure 4:
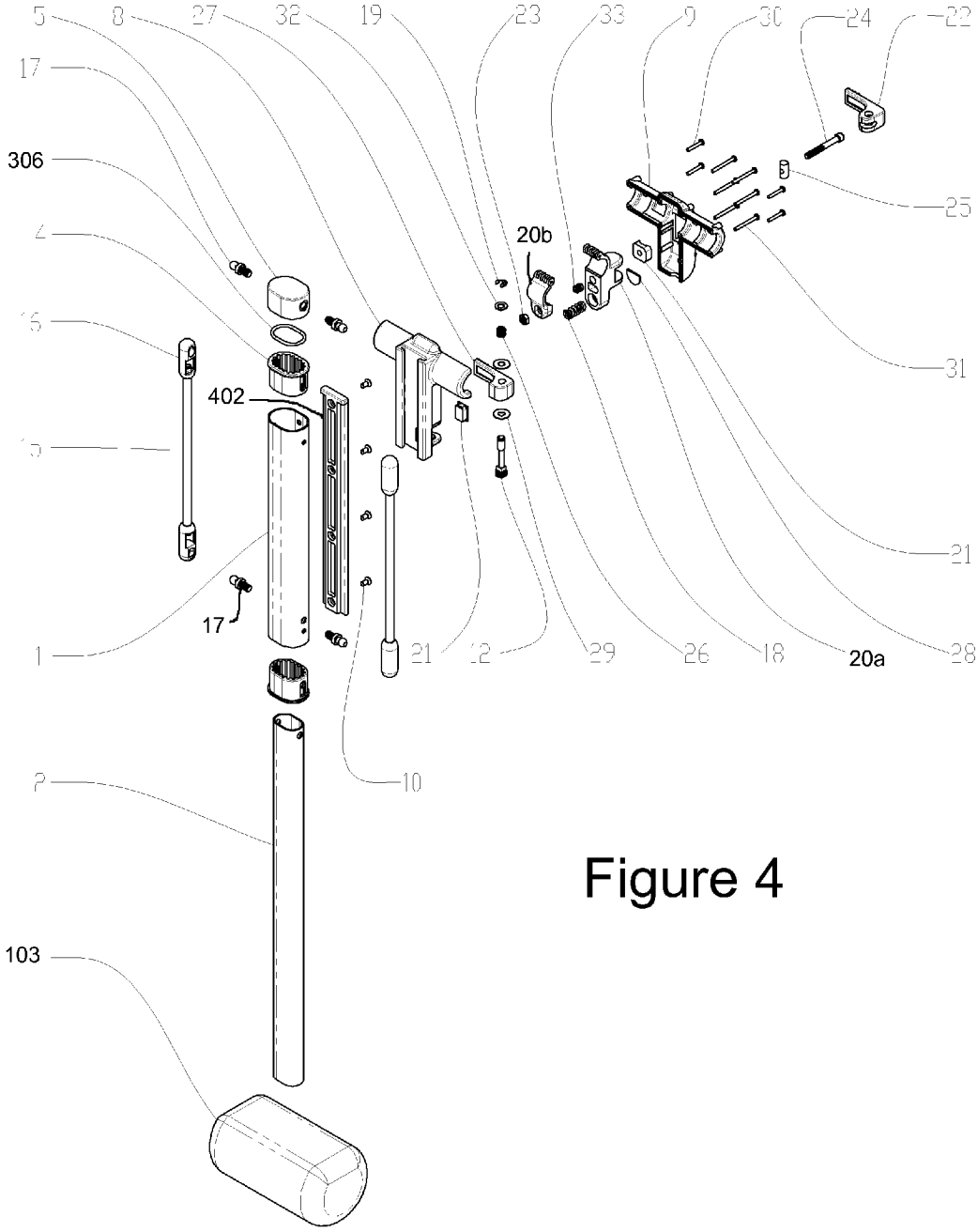
FIG. 4 is an exploded left perspective view of one embodiment of a plunger assembly that can be used in the embodiment of FIG. 1.

With reference to FIG. 4, an exploded left perspective view of the plunger assembly is shown according to one embodiment. As explained above, the guide track receiver 8 is mated to the guide track receiver clamp 9 that receives the connecting portion (6 in FIGS. 1-2) there between. In more detail, the other components of the clamp 202 include a pivot saddle clamp, shown in two pieces 20*a* and 20*b*, that fits around the connecting portion and is loosened and tightened as the clamp pivot lever 22 is opened and closed by the user. A pivot lock bolt 24 extending through a default 25, a hole in the guide track receiver clamp 9, and through the pivot saddle clamp 20*a*, 20*b* next to a slide cam washer 28, is connected to the pivot lever 22 and screws into a nut 23 on the opposite side of the pivot saddle clamp 20*a*, 20*b* to facilitate locking and releasing the clamp against the connecting portion. Screws mate the guide track receiver 8 to the guide track receiver clamp 9 to form the clamp.

In one embodiment, a spring 18 biases the angle of pivot of the plunger by biasing the angle of pivot of saddle clamp 20*a*, 20*b* within the clamp. Even after locking the plunger 11 at the desired angle to contact the user's body, a small range of pivot is still allowed. A pivot stop pad 33 restricts the range of pivot of the locked plunger 11 to between, by way of example only, and not by way of limitation, 0 and 15 degrees. In yet another embodiment, the pivot stop pad 33 restricts the range of pivot of the plunger to between, by way of example only, and not by way of limitation, 0 and 10 degrees. In yet another embodiment, the pivot stop pad 33 restricts the range of pivot of the plunger to between, by way of example only, and not by way of limitation, 0 and 5 degrees. In one embodiment, the spring 18 is used to bias the pivot angle of the plunger 11 to 0 degrees.

The slide lock lever 27 attaches to the guide track receiver 8 by means of a bolt 12 that inserts through a vertically situated hole in the guide track receiver 8. The bolt 12 fits through one or more washers 29, 32 and 19 and screws into a nut 26 to secure the bolt 12 to the guide track receiver 8. As the slide lock lever 27 is locked, it pushes a lock pad 21 into a position that provides pressure to a slide 402 that is bolted to the outer plunger tube 301 using recessed screws 10. Each detachable resistance band 15 is attachable to the plunger cap 5 and the bottom end of the outer plunger tube 301 via two saddle clamps 17.

The inner plunger tube 302 inserts through the outer plunger tube 301 through a washer 4 on the bottom of the outer plunger tube 302, through an o-ring 306, and a washer on the top of the outer plunger tube 302. The top of the inner plunger tube 302 inserts into the plunger cap 5.

Figure 5:
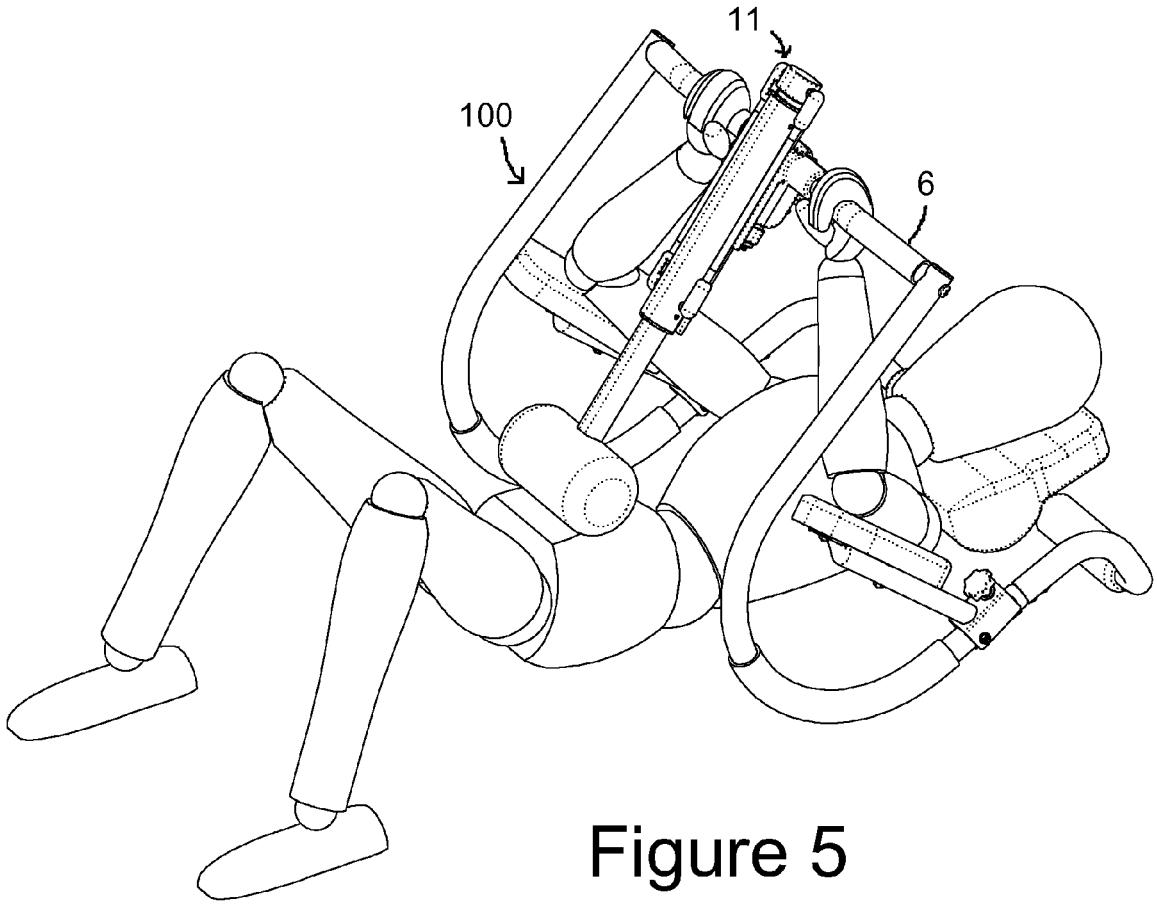
FIG. 5 is an illustration of a user using the apparatus illustrated in the embodiments of FIGS. 1-4.

With reference to FIG. 5, an illustration of a user using the apparatus 100 is shown. In FIG. 5, the user is depicted in a typical starting position for using the apparatus 100, with the hands in the overhand clasp position on the first connecting portion 6. The plunger 11 is in the extended, substantially non-compressed position at the start.

Figure 6:
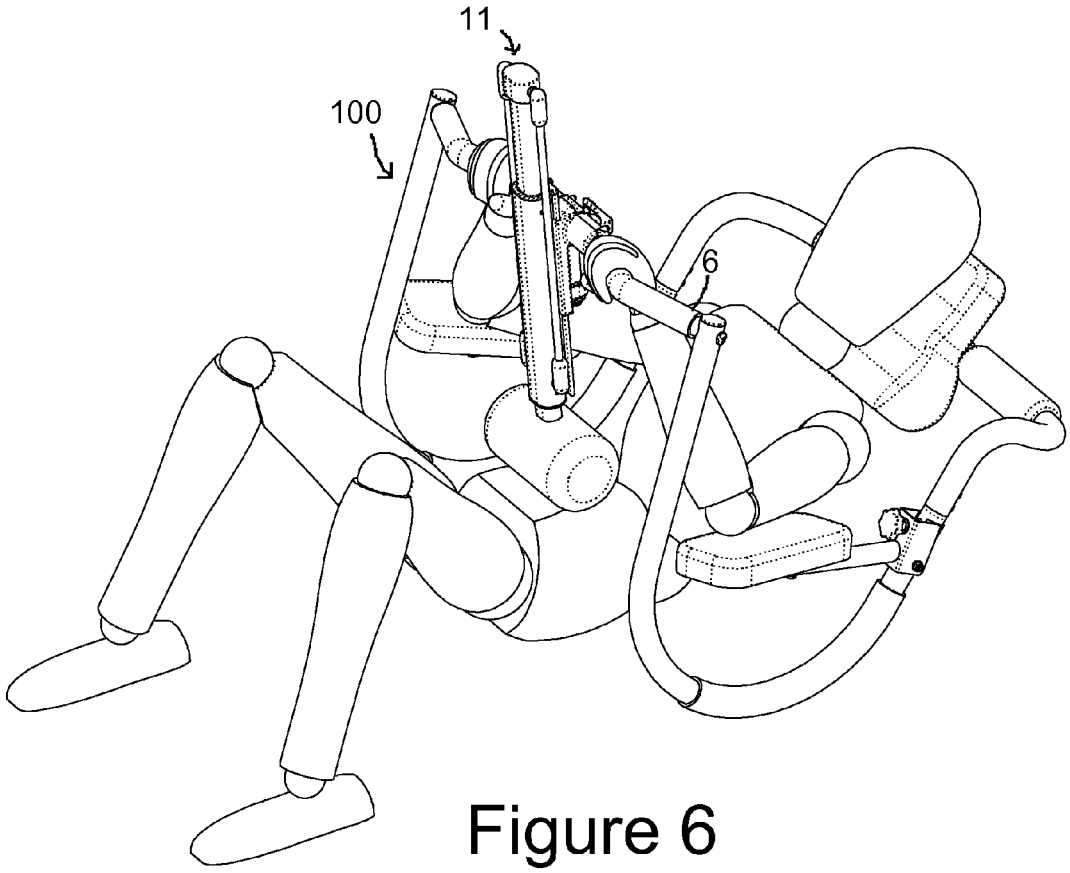
FIG. 6 is an illustration of a user in the middle of a crunch using the embodiment of FIGS. 1-4.

With reference to FIG. 6, an illustration of a user in the middle of a crunch using the apparatus 100 is shown. It should be noted that the plunger 11 is compressed at the stage of the crunch depicted in FIG. 6.

Figure 7:
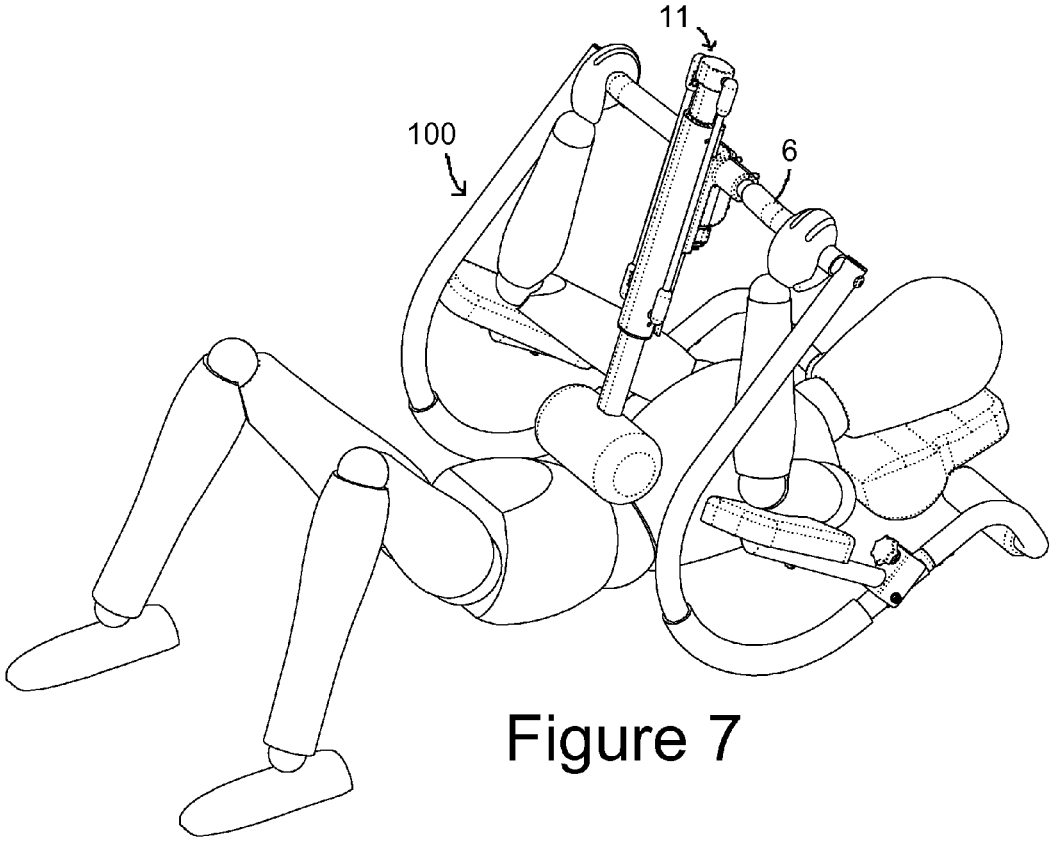
FIG. 7 is another illustration of a user using the embodiment of FIGS. 1-4.

With reference to FIG. 7, another illustration of a user using the apparatus 100 is shown. In FIG. 7, the user is again depicted in a typical starting position for using the apparatus, but with the hands in an underhand clasp position on the first connecting portion 6. Crunches are performed as described above, but with the user's hands kept in the underhand position.

Figure 8:
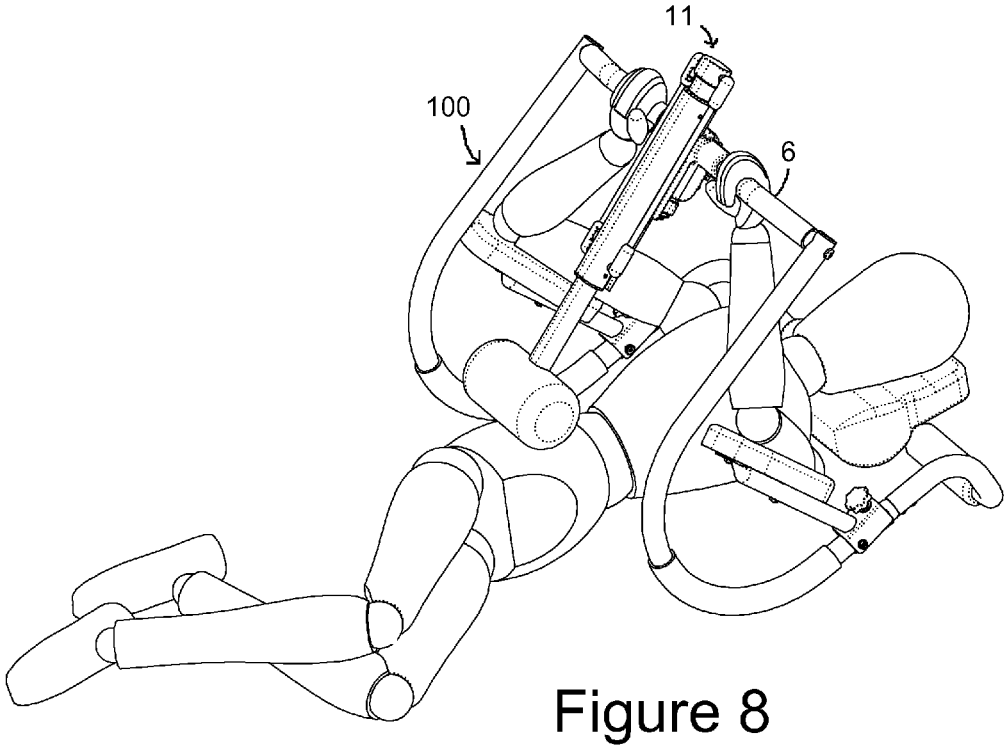
FIG. 8 is yet another illustration of a user using the embodiment of FIGS. 1-4.

With reference to FIG. 8, yet another illustration of a user using the apparatus 100 is shown. In FIG. 8, the user again has his hands in the overhand position on the first connecting portion 6. However, the user's pelvis is position in a side position on the exercise surface, and the plunger 11 has been adjusted to engage the side of the user's pelvis instead of the abdomen.

Figure 9:
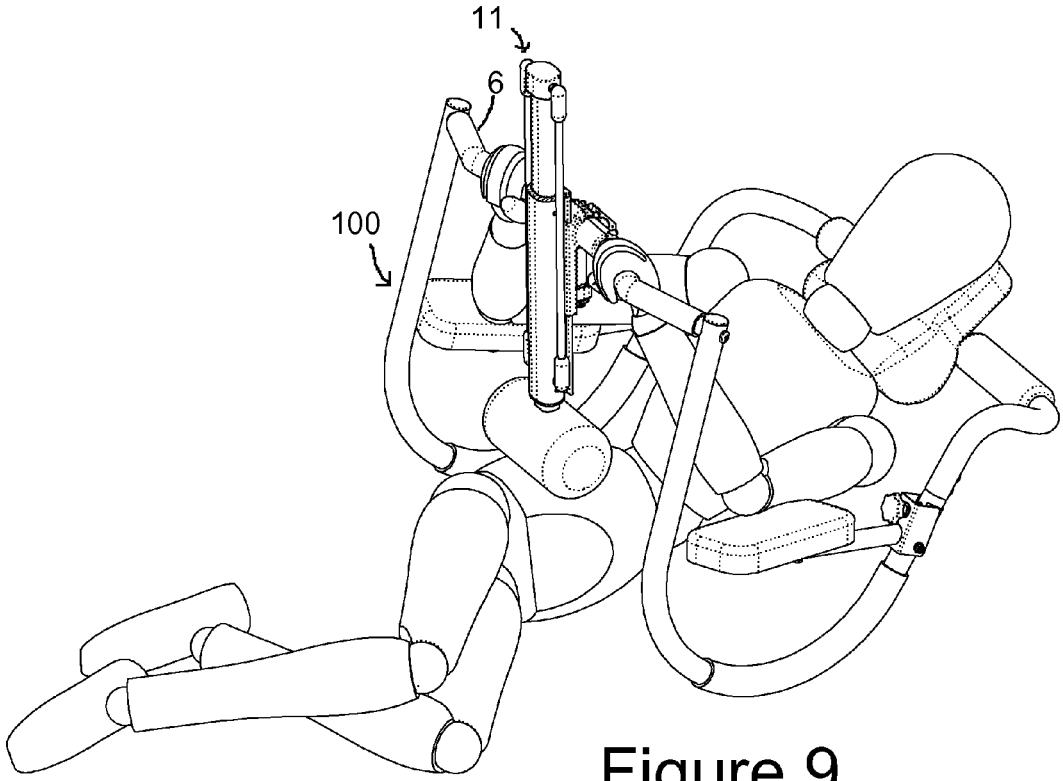
FIG. 9 is an illustration of the user performing a crunch exercise from the position of FIG. 8 according to one embodiment.

With reference to FIG. 9, the user is shown performing a crunch from position of FIG. 8. As shown in FIG. 9, the user is able to perform a side-crunch from the FIG. 8 position to work the oblique abdominal muscles.

Figure 10:
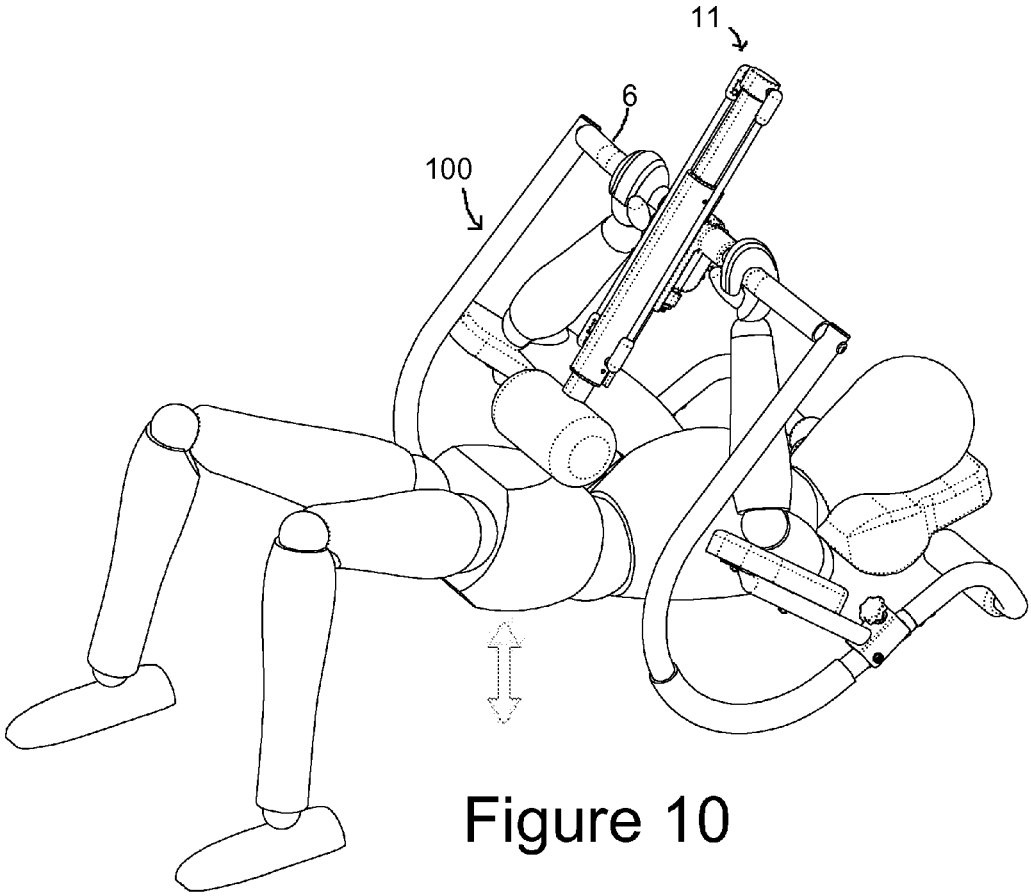
FIG. 10 is an illustration of a user performing a pelvic thrust against the plunger of the embodiment of FIGS. 1-4.

With reference to FIG. 10, a user is shown performing a pelvic thrust against the plunger 11. As shown in FIG. 10, the user is able to start from the overhand clasp position of FIG. 5, but instead of performing a crunch, the user performs pelvic thrusts (shown by the up and down arrow) against the plunger 11.

Figure 11:
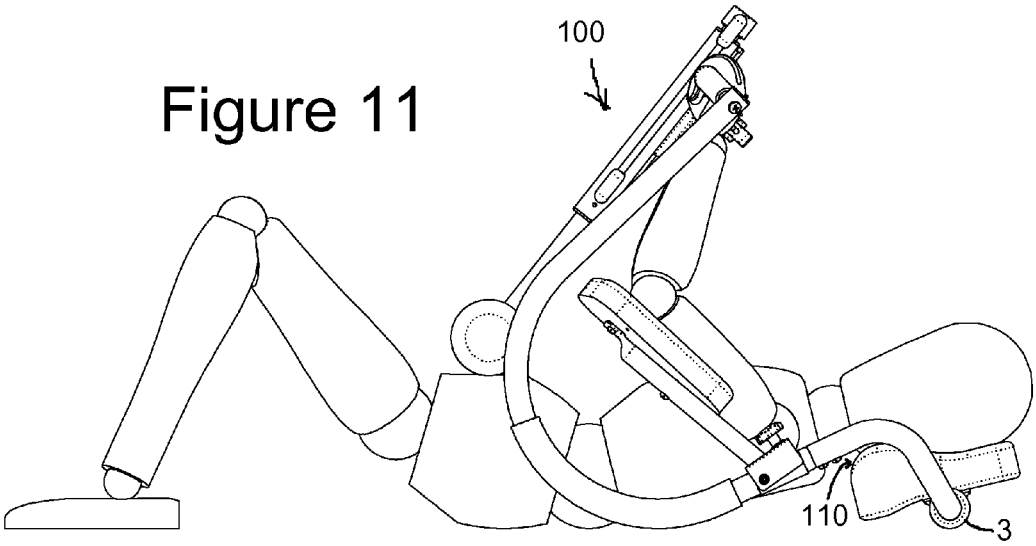
FIG. 11 is a left-side elevational view of the user of FIG. 5 using the apparatus of FIG. 5.

With reference back to FIG. 1, a novel property of the headrest 109 is noted. Specifically, in one embodiment, the headrest 109 includes a bulbous elongated portion 110. With reference to FIG. 11, a left-side elevational view of the apparatus 100 with a user in the beginning overhand position as in FIG. 5 is shown. As shown, the bulbous elongated portion 110 of the headrest 109 provides for enhanced and steady head positioning during exercise, as well as enhanced neck support, as the orthopaedic shape of the bulbous elongated portion 110 fits snugly within the curve of the neck of the user.

Figure 12:
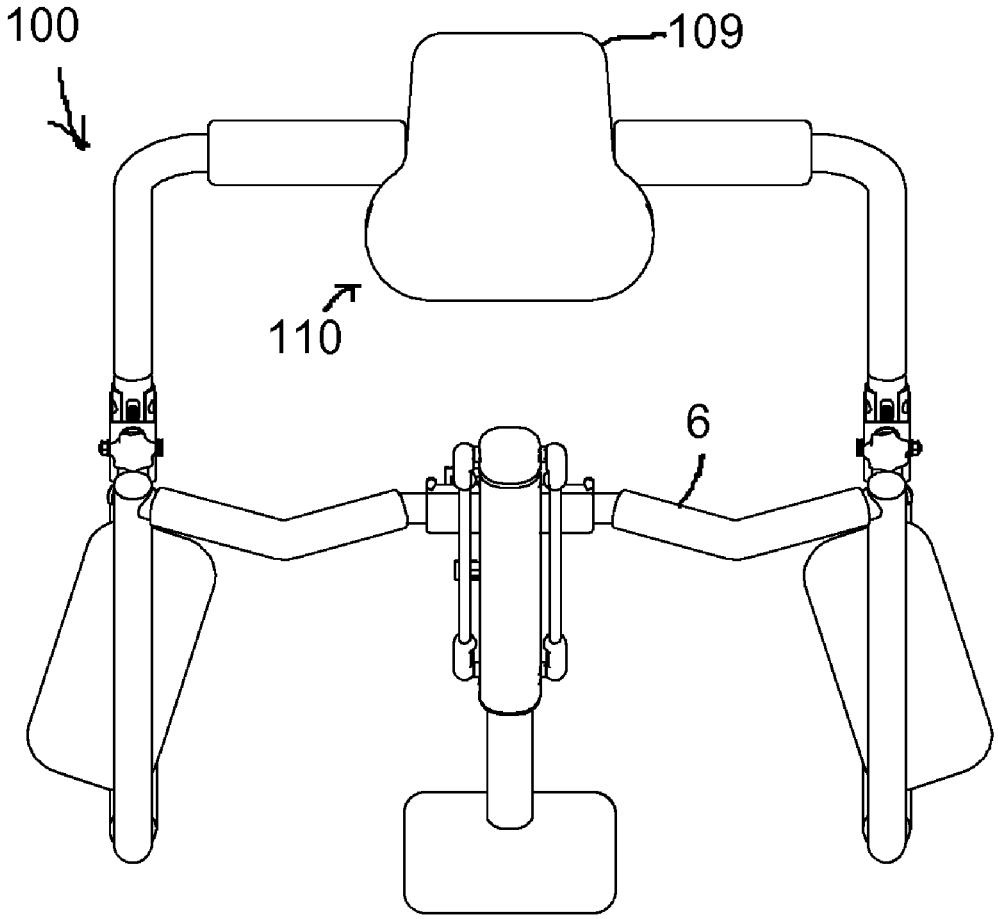
FIG. 12 is a top elevational view of the embodiment of FIGS. 1-4.

With reference to FIG. 12, a top elevational view of the apparatus 100 of FIGS. 1-4 and 11 is shown. The top of the novel shape of the bulbous elongated portion 110 of the headrest 109 can be more clearly seen. However, another novel feature of the apparatus 100 can also be more clearly seen; that being the w-shape, or zigzag-shape of the first connecting portion 6. The inside of the w-shape allows for a more natural inside hand grip on the first connecting portion 6 during exercise, wherein the fingers of the knuckles of the user, and the forearms, are more comfortably pointed inward. However, when the user's hands are placed in a more outside position on the first connecting portion 6, the outside of the w-shape provides for a more comfortable outward-facing position of the fingers, knuckles, or forearms during exercise. An example of the inside grip position is shown in FIG. 6, while an example of the outside grip position is shown in FIG. 7.

Figure 13:
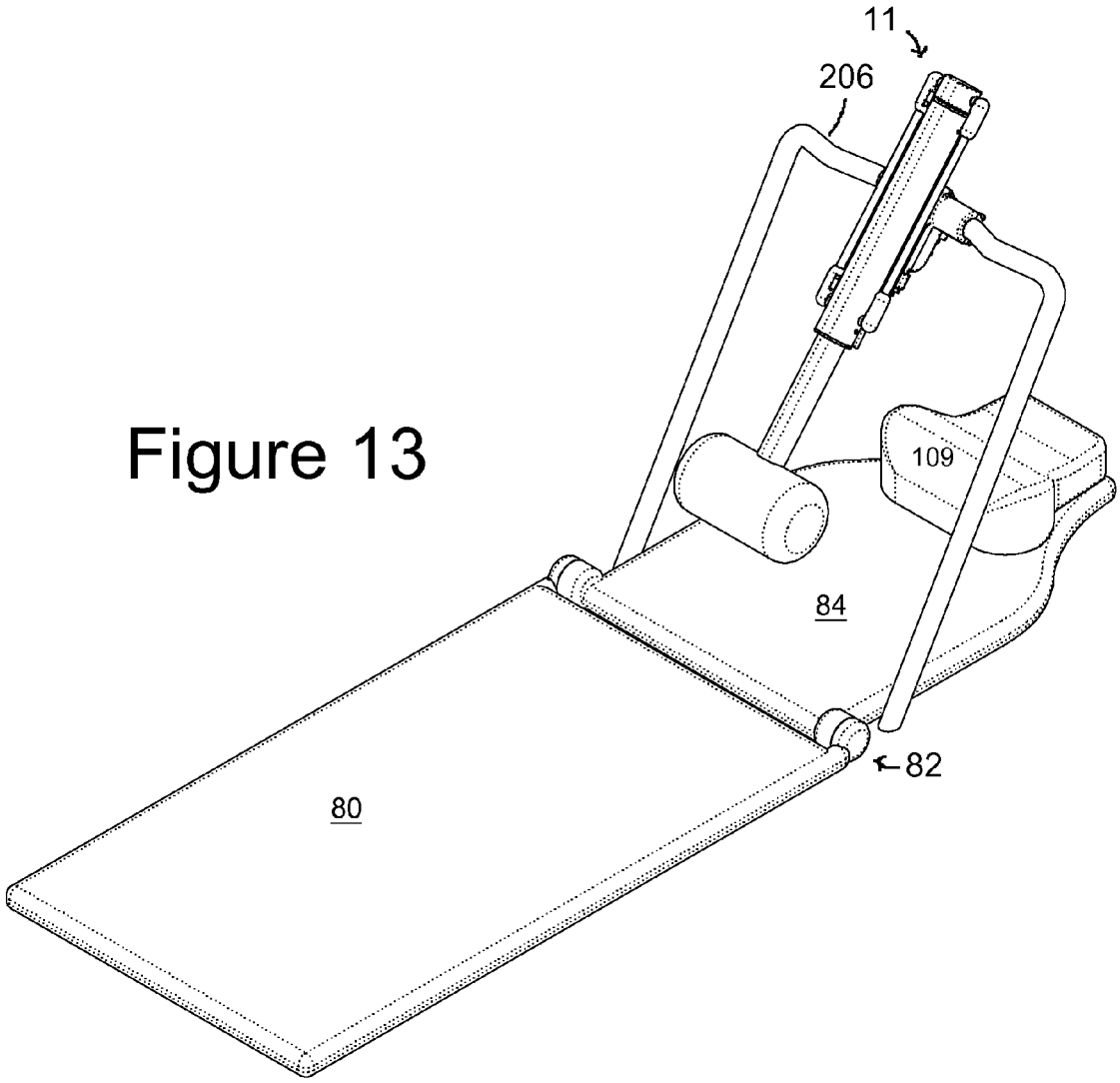
FIG. 13 is a left-top perspective view of a legacy crunch device with a novel plunger and novel headrest attached according to one embodiment.

In one embodiment, the plunger 13 and headrest 109 are used to modify a prior art or legacy device in order to transform said legacy device into a much more efficient crunch or exercise device. With reference to FIG. 13, a left-top perspective view of a legacy crunch device that has been outfitted with a plunger 11 and headrest 109 attached according to one embodiment is shown. For example, some legacy devices may include a front pad 80, connected through a hinge 82 to a back pad 84, with a crossbar 206. However, according to one embodiment, the novel plunger 11 is attached to the crossbar 206, via the clamp 202. Further, the novel headrest can be attached to the back pad 84 to support the head and neck as described above with respect to FIG. 11.

Figure 14:
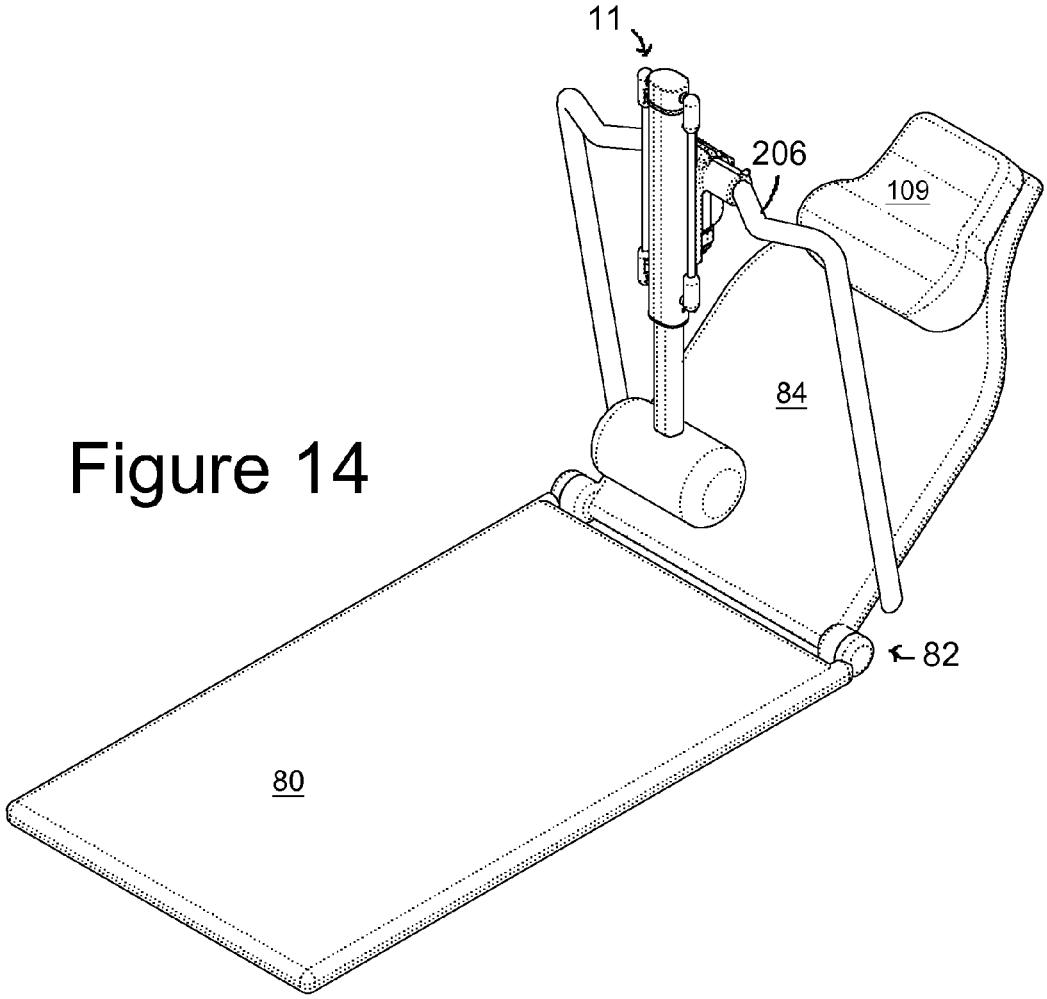
FIG. 14 is a left-top perspective view of the legacy crunch device of FIG. 13 shown in the crunch position.

With reference to FIG. 14, a left-top perspective view of the embodiment of FIG. 13 is shown. Similar to the embodiment of FIGS. 1-4, the orientation of the plunger 11 attached to the cross bar, which is attached to the legacy back pad 84, provides for rotation of the plunger 11 along with angular rotation at the hinge 82 with the back pad 84 to provide for a relative consistent kinetic and isometric pressure on the selected point of the body that the user has selected for the plunger 11 while exercising.

The various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed is:

1. A plunger for providing kinetic pressure on a person's body part on a crunch exercise device, the crunch exercise device having a crossbar, comprising:

a first clamp for providing attachability of the plunger to the crossbar, the first clamp further providing for adjustability of the angle of rotation of the plunger on the crossbar, and thereby providing for selectability of the body part on which kinetic pressure is provided by the plunger; and a slide;

a second clamp for providing vertical adjustability of the plunger with respect to the crossbar; and wherein the plunger comprises an adjustable resistance plunger.

2. The plunger of claim 1, wherein the plunger comprises a gas-filled piston.

3. The plunger of claim 1, wherein the plunger comprises a spring loaded piston.

4. The plunger of claim 1, wherein the plunger further comprises one or more detachable resistance bands to adjust the resistance provided by the plunger.

5. An exercise device, comprising:

a pair of laterally spaced u-shaped support rails for rocking back and forth on a surface;

a first crossbar connecting the support rails above the contact point to the surface;

a second crossbar connecting the support rails behind the contact point to the surface; and a plunger connected to said first crossbar whereby a person disposed supinely on said surface and between said support rails and with one of the hands the person engaging said first crossbar is able to conduct a curling exercise while rocking said device, and wherein said plunger is positioned to engage a person's body part to provide an kinetic and isometric force on said body part.

6. The exercise device of claim 5, wherein the first crossbar comprises an upper crossbar having a zigzag shape.

7. The apparatus of claim 5, wherein the plunger comprises a gas-filled piston.

8. The apparatus of claim 5, wherein the plunger comprises a spring loaded piston.

9. The apparatus of claim 5, wherein the plunger comprises an adjustable resistance plunger.

10. The apparatus of claim 9, wherein the plunger further comprises one or more detachable resistance bands to adjust the resistance provided by the plunger.

11. The apparatus of claim 5, wherein the plunger has a top and a bottom, the bottom comprising the portion that engages the user's abdomen, wherein the distance between the first crossbar and the bottom of the plunger is adjustable.

12. The apparatus of claim 5, wherein the plunger is mounted on the first crossbar with a clamp that allows the plunger to pivot with respect to the connecting portion.

13. The apparatus of claim 12, further comprising a pivot stop pad for restricting the range of pivot of the plunger to between 0 and 15 degrees.

14. The apparatus of claim 5, further comprising a headrest attached to the second crossbar.

15. The apparatus of claim 14, wherein the headrest contains a widened bulbous portion to fit under the person's neck during the curing exercise.

16. The apparatus of claim 5, wherein the plunger is vertically adjustable with respect to the first crossbar.

17. The apparatus of claim 16, further comprising a guide track receiver, the plunger further comprising a slide capable of receiving the guide track receiver making the plunger vertically adjustable.

* * * * *